US008820590B2

(12) United States Patent
Krallmann

(10) Patent No.: US 8,820,590 B2
(45) Date of Patent: Sep. 2, 2014

(54) DEFORMABLE SMALL PACKAGING STRUCTURE

(75) Inventor: Rainer Krallmann, Hiddenhausen (DE)

(73) Assignee: BERICAP Holding GmbH, Budenheim (DE)

( * ) Notice: Subject to any disclaimer, the term of this patent is extended or adjusted under 35 U.S.C. 154(b) by 0 days.

(21) Appl. No.: 13/253,546

(22) Filed: Oct. 5, 2011

(65) Prior Publication Data

US 2012/0024912 A1 Feb. 2, 2012

Related U.S. Application Data

(63) Continuation of application No. 12/121,147, filed on May 15, 2008, now abandoned.

(30) Foreign Application Priority Data

May 16, 2007 (EP) ..... 07108355

(51) Int. Cl.
*B65D 35/38* (2006.01)
*B65D 47/20* (2006.01)
*B65D 47/06* (2006.01)

(52) U.S. Cl.
CPC ..... *B65D 47/2031* (2013.01); *B65D 2547/066* (2013.01); *B65D 47/063* (2013.01)
USPC ..... 222/484; 222/212; 222/490; 220/203.11; 137/843

(58) Field of Classification Search
CPC ..... B65D 47/2031; B65D 47/063; B65D 47/0809; B65D 2547/066
USPC ..... 222/206, 212, 213, 215, 490, 491, 494, 222/495–497; 137/843–847, 849; 220/203.11, 203.15, 203.18
See application file for complete search history.

(56) References Cited

U.S. PATENT DOCUMENTS

| | | | | |
|---|---|---|---|---|
| 2,758,755 | A | 8/1956 | Schafler | |
| 4,053,084 | A * | 10/1977 | Anderson | 220/229 |
| 5,924,605 | A * | 7/1999 | Baudin et al. | 222/494 |
| 6,062,436 | A * | 5/2000 | Fuchs | 222/212 |
| 6,367,668 | B1 | 4/2002 | Schwanenberg | |

(Continued)

FOREIGN PATENT DOCUMENTS

| | | |
|---|---|---|
| DE | 73 30 261 U | 3/1976 |
| EP | 0 395 380 A2 | 10/1990 |

(Continued)

*Primary Examiner* — J. Casimer Jacyna
(74) *Attorney, Agent, or Firm* — Henry M. Feiereisen LLC

(57) ABSTRACT

A deformable small packaging structure for free-flowing products has a valve-like closure (10) produced by a two-component injection molding process and including a dimensionally stable carrier element (11) and an outer jacket (12) which envelopes the carrier element (11) at least in part and has a flexible squirt-nozzle (16) with slotted openings. The outer jacket (12), in relation to the withdrawn squirt-nozzle (16), has a meander-shaped configuration adjacent to the squirt-nozzle (16). The squirt-nozzle (16), in relation to the withdrawn state, is configured as a pot-shaped recess. The outer jacket (12) has an inner annular flange (17) which engages in a recess of the carrier element (11) and is firmly connected therewith. Further, the outer jacket (12) has adjacent to the inner annular flange (17) a circumferential web (18) which engages in a groove of the carrier element (11) and is also firmly connected therewith.

14 Claims, 4 Drawing Sheets

(56) References Cited

U.S. PATENT DOCUMENTS

| | | | | |
|---|---|---|---|---|
| 6,726,063 | B2 | 4/2004 | Stull et al. | |
| 7,255,250 | B2 * | 8/2007 | Pugne | 222/556 |
| 7,299,952 | B2 * | 11/2007 | Stull et al. | 222/212 |
| 2003/0057237 | A1 | 3/2003 | Stull et al. | |
| 2007/0295765 | A1 | 12/2007 | Bull et al. | |
| 2009/0321479 | A1 * | 12/2009 | Fontana | 222/494 |

FOREIGN PATENT DOCUMENTS

| | | | |
|---|---|---|---|
| EP | 0 586 778 | A | 3/1994 |
| FR | 2 606 377 | A1 | 5/1988 |
| WO | WO 98/02361 | A | 1/1998 |

* cited by examiner

DEFORMABLE SMALL PACKAGING STRUCTURE

CROSS-REFERENCES TO RELATED APPLICATIONS

This application is a continuation of prior filed copending U.S. application Ser. No. 12/121,147, filed May 15, 2008, the priority of which is hereby claimed under 35 U.S.C. §120 and which claims the priority of European Patent Application, Serial No. 07108355.4, filed May 16, 2007, pursuant to 35 U.S.C. 119(a)-(d).

BACKGROUND OF THE INVENTION

The invention relates to a deformable small packaging structure for free-flowing products, having a valve-like closure produced by a two-component injection molding process and including a dimensionally stable carrier element and an outer jacket which envelopes the carrier element at least in part and has a flexible squirt-nozzle with slotted openings.

The small packaging structure involved here is normally manufactured from a suitable plastic so that it can be squeezed together by hand to allow the product to be pushed through the valve-like closure.

When a sufficient quantity has been dispensed, the small packaging structure relaxes to return to the original shape. Small packaging structures involve preferably tubes, bottles, and the like. The closure is configured in such a manner as to open, when pressure is applied onto the product, and to spontaneously close again, after this pressure decreases. Moreover, the closure is designed so as to allow the product to be squeezed out from the small packaging structure in controlled doses. Products involved here include foodstuff in the form of condiments, for example mustard, mayonnaise, ketchup, and the like.

The dimensionally stable carrier element is firmly placed onto the small packaging structure. The squirt-nozzle of the outer jacket is then located within this carrier element. Depending on the configuration, the carrier element is secured either on the neck of the small packaging structure or on the closing flap. It is further still possible to place onto the small packaging structure a cap closure which surrounds at least the outer jacket. This cap may be configured as screw cap, but may also be placed over the upper neck of the small packaging structure under elastic deformation. In these cases, the screw cap is provided with an opening which can be closed by a flap so that the user has to open this flap before dispensing the content from the small packaging structure.

Although the afore-described embodiment of the closure has proven itself, it still requires a fairly large free space in order to be able to transfer the squirt-nozzle into the position that clears the openings.

SUMMARY OF THE INVENTION

The invention is based on the object to configure a deformable small packaging structure of the afore-described type is such a manner that the squirt-nozzle occupies an extremely small space, when withdrawn, and that the change to the position to clear the openings is possible with little force. Furthermore, the small packaging structure should be configured in such a manner that most different foodstuffs can be filled without hesitation.

The posed object is solved by configuring the outer jacket in relation to the withdrawn squirt-nozzle in the shape of a meander in an area adjacent to the squirt-nozzle. As a result of the meandering configuration of the outer jacket adjacent to the squirt-nozzle, relatively little space is required for the withdrawn squirt-nozzle while the squirt-nozzle is of relatively large volume, when pressure is applied onto the small packaging structure, as the meandering shape is unraveled.

According to a preferred embodiment, the squirt-nozzle is configured in relation to the withdrawn state in the form of a pot-shaped recess. As a result, a closure is realized which is comparable to a valve. As soon as the deformable small packaging structure is deformed by forces acting from outside, the squirt-nozzle springs into the outwardly bulged state to allow the product to flow out.

According to a still further preferred embodiment, the outer jacket has an inner annular flange which sealingly engages in a recess of the carrier element and is connected therewith. As the carrier element and the outer jacket are produced from plastic by a two-component injection molding process, the carrier element is injection-molded first. The inner annular flange causes an intimate connection of the carrier element with the outer jacket during the subsequent injection molding operation. This component is further improved by providing the outer jacket adjacent to the inner annular flange with a circumferential web which engages in a groove of the carrier element and is connected therewith. Also this web forms an intimate connection with the groove so that a detachment of the outer jacket from the carrier element is prevented even after extended use.

In addition, the carrier element is provided with external thread turns for receiving a screw cap. The screw cap is provided with a corresponding central flap so that the deformable small packaging structure can be closed and the flap is opened before the product is dispensed.

A material-saving embodiment is realized, when the carrier element has a step-shaped cross section, with the area receiving the outer jacket having a smaller diameter than the area facing the body of the small packaging structure.

According to an alternative embodiment, the carrier element has a sleeve-shaped configuration and includes in an area adjacent to the outer jacket an annular groove which is bounded by two groove walls, and the carrier element is recessed inwards above the annular groove. The outer jacket then ends hereby in a particularly advantageous manner adjacent to the upper groove wall.

In order to close the slits of the squirt-nozzle in a valve-like manner, when the force acting on the small packaging structure drops, so that no product can continue to flow, several radial stabilizing ribs are arranged between the squirt-nozzle and the annular flange at an angular distance to one another. These stabilizing ribs promote closing of the slits of the squirt-nozzle. In an especially advantageous manner, the stabilizing ribs are formed onto the squirt-nozzle and end at a distance to the annular flange.

In order to be able to fill most different foodstuffs into the small packaging structure, at least the squirt-nozzle is made of oil-resistant plastic. Furthermore, it is provided that the small packaging structure is made of oil-resistant plastic at least in an area of the shoulder adjacent to the closure. Preferably, the resistant material is a thermoplastic vulcanized material (TPV).

BRIEF DESCRIPTION OF THE DRAWING

The invention is described in greater detail with reference to the attached drawings.

It is shown in.

DETAILED DESCRIPTION OF PREFERRED EMBODIMENTS

Figure 1:
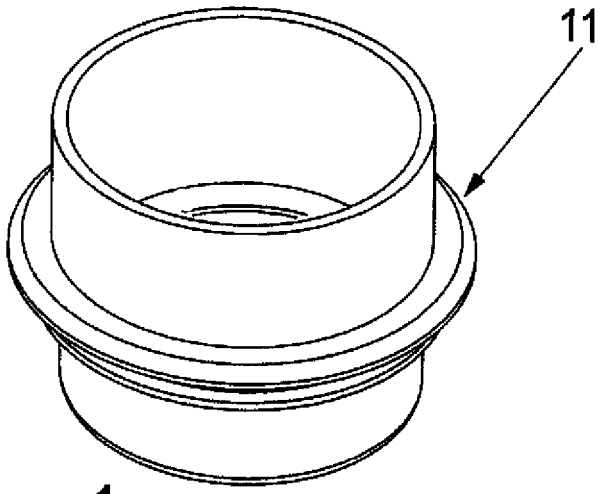
FIG. 1 a perspective illustration of the dimensionally stable carrier element as individual part, FIG. 2 a perspective illustration of the outer jacket with squirt-nozzle as individual part, FIG. 3 a vertical section of the closure comprised of the two individual parts according to FIGS. 1 and 2, FIG. 4 a sectional view of a further embodiment of the closure, FIG. 5 a detail V in FIG. 4 on an enlarged scale, FIG. 6 the closure according to FIG. 4 in a 90° rotated disposition, FIG. 7 a perspective view of the carrier element for the embodiment according to FIGS. 4 to 6, and FIGS. 8 and 9 details of the squirt-nozzle in two different views.
Figure 2:
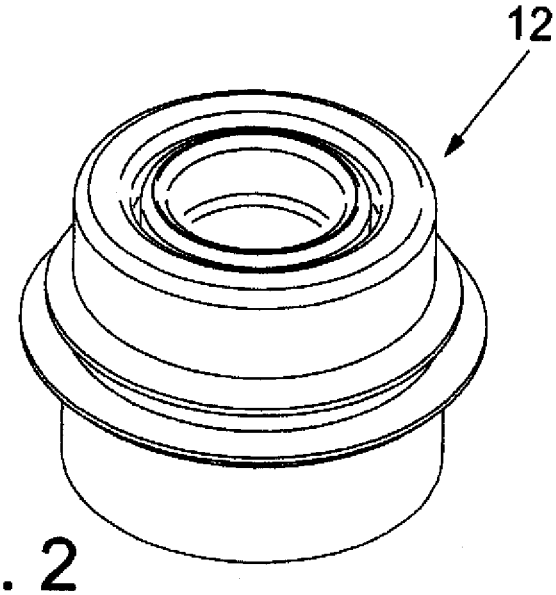
Figure 3:
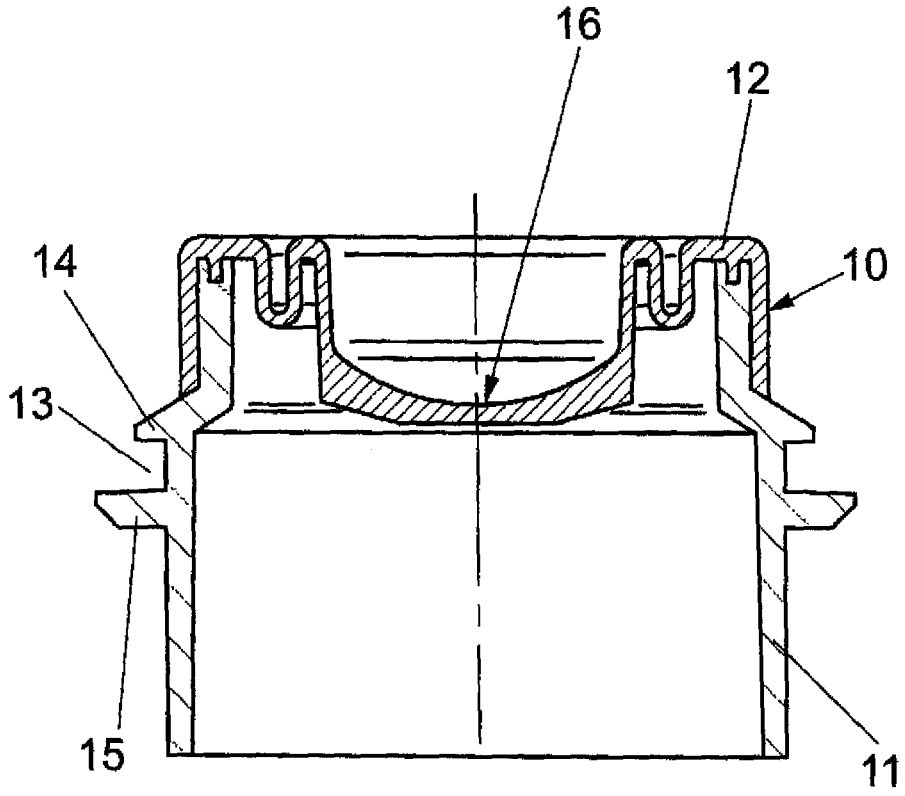

The closure 10 depicted in FIG. 3 includes a dimensionally stable carrier element 11, shown in FIG. 3, and an outer jacket 12 which faces away from the area of the unillustrated small packaging structure and is shown as detail in FIG. 2. The closure 10 is made by a two-component injection molding process by which the carrier element 11 is first injection-molded and then the outer jacket 12. The carrier element 11 has a sleeve-shaped configuration. The area of the carrier element 11 proximal to the outer jacket 12 is recessed inwards, with an annular groove 13 adjoining thereto and bounded by groove walls 14, 15 which project out in relation to the outer surface. The outer jacket 12 includes a squirt-nozzle 16 with at least one slotted discharge opening. Preferred however is an embodiment in which the squirt-nozzle 16 is provided with two intersecting slotted openings. The outer jacket 12 has a meandering configuration adjacent to this squirt-nozzle 16. As a result, this area can deform, when pressure is applied by hand from outside onto the small packaging structure in order to dispense the content through the squirt-nozzle 16. The production using the two-component injection molding process is not only efficient but results also in an intimate connection between the contacting surfaces of the carrier element 11 and the outer jacket 12.

Figure 4:
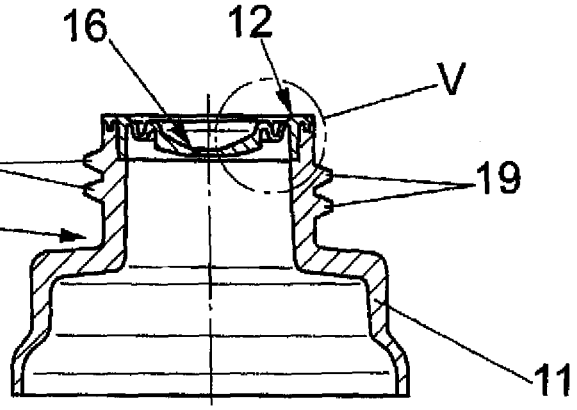
Figure 5:
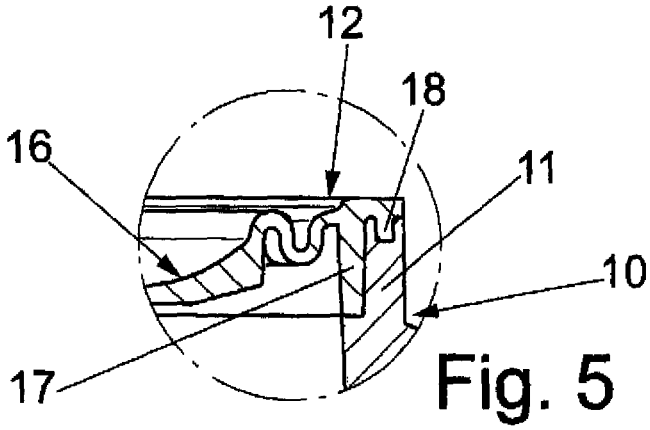
Figure 6:
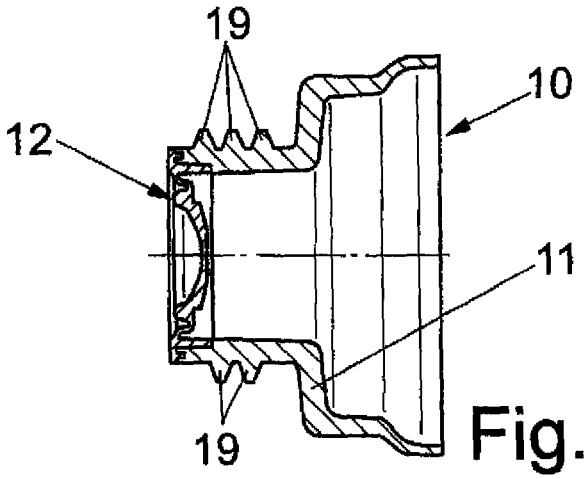

The closure 10 according to FIGS. 4 to 6 also includes a carrier element 11 and an outer jacket 12. Also this closure 10 is made by a two-component injection molding process, with the carrier element 11 being injection-molded first and then the outer jacket 12. Also the area adjacent to the squirt-nozzle 16 has a meandering configuration. As especially clearly shown in FIG. 5, the outer jacket 12 is provided with an inner annular flange 17 and firmly connected with the adjacent surface of the carrier element 11 as a result of the production process. FIG. 5 shows further the provision of a circumferential web 18 adjacent to the outside of the inner annular flange 17 for engagement in a respective groove of the carrier element 11. The inner annular flange 17 and the circumferential web 18 provide an extremely intimate connection of the carrier element 11 with the outer jacket 12. As shown in FIGS. 4 and 6, the carrier element 11 is provided on the outside with external thread turns 19 to allow detachable placement of an unillustrated screw cap onto the closure. FIGS. 4 and 6 further show the step-shaped configuration of the carrier element 11, with the area facing the squirt-nozzle 16 being smaller in diameter.

Figure 9:
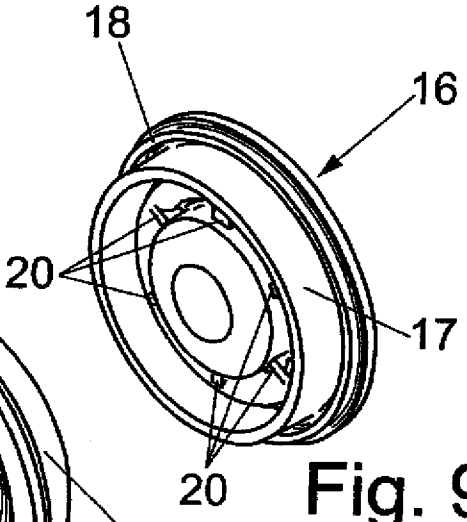
Figure 8:
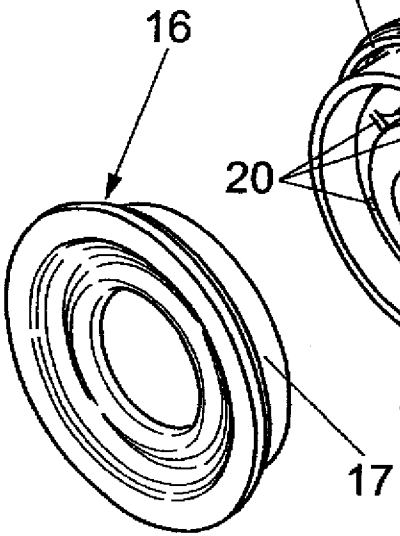
Figure 7:
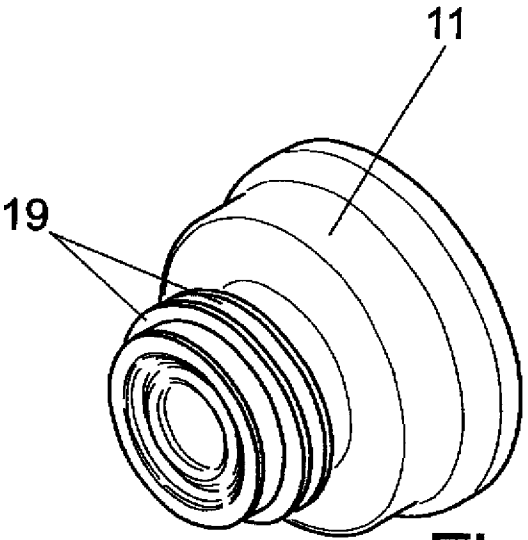

The outer shape is shown in particular also in FIG. 7. Accordingly, the carrier element 11 expands on the side facing away from the squirt-nozzle 16. FIGS. 8 and 9 show a detail of the squirt-nozzle 16. Accordingly, in particular the height of the annular flange 17 can be seen. FIG. 9 further shows the outer adjoining and circumferential web 18.

FIG. 9 shows also the presence of radial stabilizing ribs 20 which are formed on the squirt-nozzle 16 and end at a distance shy of the annular flange 17. These stabilizing ribs effect an immediate and exact closing of the slots of the squirt-nozzle as soon as the small packaging structure becomes pressure-less.

At least the squirt-nozzle 16, preferably however the entire outer jacket is made of oil-resistant plastic. With respect to the small packaging structure, at least the shoulder associated to the closure 10 should be made of same material. Such a material is a thermoplastic vulcanized material (TPV).

The invention is not limited to the illustrated exemplary embodiment. It is only essential that at least the squirt-nozzle 16, preferably however the entire outer jacket and, optionally, also the shoulder of the small packaging structure associated to the closure 10 are made of oil-resistant plastic.

What is claimed is:

1. A deformable small packaging structure for free-flowing products, comprising a valve-like closure produced by a two-component injection molding process and including a dimensionally stable carrier element and an outer jacket which envelopes the carrier element at least in part and has a flexible squirt-nozzle with slotted openings, said outer jacket having an annular flange in engagement with the carrier element and said outer jacket having, in relation to the retracted squirt-nozzle, a meander-shaped configuration adjacent to the squirt-nozzle, said meander-shaped configuration comprising two concentric annular portions having adjacent, mutually inverted U-shaped cross sections, the radial inner U-shaped portion thereof being defined by an axially extending outer annular wall of the squirt-nozzle and an inner axially extending annular wall of said adjacent radially outer U-shaped portion of the outer jacket, and wherein the squirt-nozzle has formed thereon several radial stabilizing ribs which extend from the squirt nozzle and end at a distance short of the annular flange, which stabilizing ribs are bridging the radial inner U-shaped cross section of the meander shaped configuration and are arranged at an angular distance from one another.

2. The deformable small packaging structure of claim 1, wherein the squirt-nozzle, in relation to the withdrawn state, is configured as a pot-shaped recess.

3. The deformable small packaging structure of claim 1, wherein the outer jacket has a circumferential web disposed adjacent to the annular flange and firmly engages in a groove of the carrier element.

4. The deformable small packaging structure of claim 1, wherein the carrier element has outer thread turns for receiving a screw cap.

5. The deformable small packaging structure of claim 1, further comprising a body adjacent to the closure, wherein the carrier element has a step-shaped cross section and has an area which receives the outer jacket and has a smaller diameter than an area facing the body.

6. The deformable small packaging structure of claim 1, wherein the carrier element has a sleeve-shaped configuration and includes adjacent to the outer jacket an annular groove which is bounded by two groove walls, said carrier element being recessed inwardly above the annular groove.

7. The deformable small packaging structure of claim 1, wherein the radial stabilizing ribs are arranged between the squirt-nozzle and the annular flange.

8. The deformable small packaging structure of claim 6, wherein the outer jacket is recessed inwards adjacent to an upper one of the groove walls.

9. The deformable small packaging structure of claim 6, wherein the outer jacket ends adjacent to an upper one of the groove walls.

10. The deformable small packaging structure of claim 1, wherein at least the squirt-nozzle is made of oil-resistant plastic.

11. The deformable small packaging structure of claim 10, wherein the oil-resistant material is thermoplastic vulcanized material (TPV).

12. The deformable small packaging structure of claim 1, further comprising a body having a shoulder adjacent to the squirt-nozzle, wherein at least the shoulder of the body is made of oil-resistant material.

13. The deformable small packaging structure of claim 12, wherein the oil-resistant material is thermoplastic vulcanized material (TPV).

14. The deformable small packaging structure of claim 1, wherein the annular flange engages in a recess of the carrier element.

* * * * *